US012709442B2

(12) United States Patent
Falzoni

(10) Patent No.: US 12,709,442 B2
(45) Date of Patent: Aug. 18, 2026

(54) CAP FOR CONTAINERS

(71) Applicant: SACMI COOPERATIVA MECCANICI IMOLA SOCIETA' COOPERATIVA, Imola (IT)

(72) Inventor: Alessandro Falzoni, Imola (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 0 days.

(21) Appl. No.: 18/695,207

(22) PCT Filed: Oct. 7, 2022

(86) PCT No.: PCT/IB2022/059613
§ 371 (c)(1),
(2) Date: Mar. 25, 2024

(87) PCT Pub. No.: WO2023/057978
PCT Pub. Date: Apr. 13, 2023

(65) Prior Publication Data

US 2024/0391649 A1 Nov. 28, 2024

(30) Foreign Application Priority Data

Oct. 7, 2021 (IT) ..... 102021000025709

(51) Int. Cl.
*B65D 41/04* (2006.01)

(52) U.S. Cl.
CPC ..... *B65D 41/0421* (2013.01); *B65D 2401/30* (2020.05)

(58) Field of Classification Search
CPC ..... B65D 41/0421; B65D 41/325; B65D 41/3428; B65D 41/34; B65D 41/32;
(Continued)

(56) References Cited

U.S. PATENT DOCUMENTS 742,435 A * 10/1903 Hughes ..... B65D 51/145 215/276
3,568,871 A * 3/1971 Livingstone ..... B65D 41/185 215/354

(Continued)

FOREIGN PATENT DOCUMENTS

CN 1313233 A 9/2001
CN 110546079 A 12/2019

(Continued)

OTHER PUBLICATIONS

International Search Report and Written Opinion, issued on Nov. 16, 2022, in PCT/IB2022/059613, 9 pages.

*Primary Examiner* — Orlando E Aviles
*Assistant Examiner* — Brijesh V. Patel
(74) *Attorney, Agent, or Firm* — Chrisman Gallo Tochtrop LLC

(57) ABSTRACT

A cap for a container that includes an end wall, a skirt which extends about an axis and a corner zone interposed between the end wall and the skirt. The corner zone includes a first wall portion which projects from the skirt towards the inside of the cap and a second wall portion which protrudes from the end wall and is joined to the first wall portion. The first wall portion and the second wall portion define a step on a surface of the corner zone facing towards the outside of the cap. The cap also includes an annular sealing lip which extends towards a free edge of the skirt from a region in which the first wall portion is joined to the second wall portion. The annular sealing lip is delimited by an inner surface configured to engage with an outer lateral surface of a neck of the container.

20 Claims, 4 Drawing Sheets

(58) Field of Classification Search
CPC ..... B65D 41/3452; B65D 41/3447; B65D 41/06; B65D 41/0428; B65D 41/04; B65D 41/005; B65D 55/02; B65D 1/0246; B65D 1/023; B65D 1/0223; B65D 2401/30; B65D 2205/00
USPC ... 215/252–253, 250, 343–344, 341, 44, 43, 215/329, 316; 220/300, 293, 288, 296
See application file for complete search history.

(56) References Cited

U.S. PATENT DOCUMENTS 3,812,994 A * 5/1974 Feldman ..... B65D 41/3404 215/256
3,827,592 A * 8/1974 Deussen ..... B65D 50/067 215/217
3,840,143 A * 10/1974 Davis ..... B65D 43/0231 206/520
4,562,931 A * 1/1986 Brach ..... B65D 50/041 215/256
4,770,306 A * 9/1988 Szczesniak ..... B65D 41/3447 215/253
4,948,001 A * 8/1990 Magly ..... B29C 49/48 220/296
5,004,112 A * 4/1991 McBride ..... B65D 41/3428 215/252
5,050,753 A * 9/1991 Trump ..... B65D 41/3428 215/253
5,161,707 A 11/1992 Dutt et al.
5,205,426 A * 4/1993 McBride ..... B65D 41/3428 215/252
5,267,661 A * 12/1993 Luch ..... B65D 41/0421 215/354
5,320,234 A * 6/1994 Kamath ..... B65D 41/3409 215/252
5,462,186 A * 10/1995 Ladina ..... B65D 51/1688 220/240
5,489,036 A * 2/1996 Arkins ..... B65D 41/0421 215/44
5,501,349 A * 3/1996 McCandless ..... B65D 41/3442 215/252
5,533,633 A * 7/1996 King ..... B65D 41/3409 220/296
5,542,556 A * 8/1996 Ohmi ..... B65D 41/04 215/349
5,630,520 A * 5/1997 Luch ..... B65D 41/3409 215/256
5,673,809 A * 10/1997 Ohmi ..... B65D 41/045 215/343
D392,187 S * 3/1998 King ..... D9/453
5,860,542 A * 1/1999 Takamatsu ..... B65D 41/3428 215/44
5,871,111 A * 2/1999 Pfefferkorn ..... B65D 41/0421 215/354
5,975,321 A * 11/1999 Luch ..... B65D 41/0471 215/354
6,006,930 A * 12/1999 Dreyer ..... B65D 51/1688 215/44
6,089,390 A * 7/2000 Druitt ..... B65D 41/3447 215/307
6,382,445 B1 * 5/2002 McCandless ..... B65D 41/0428 215/DIG. 1
6,415,935 B1 * 7/2002 Hins ..... B65D 41/0471 215/44
6,659,297 B2 * 12/2003 Gregory ..... B65D 41/045 215/44
6,913,157 B2 * 7/2005 Oh ..... B65D 41/04 220/296
6,913,158 B1 * 7/2005 Bosl ..... B65D 41/0471 215/331
6,926,165 B2 * 8/2005 Conti ..... B65D 43/0231 215/217
6,981,602 B2 * 1/2006 Ma ..... B29C 43/50 215/256
7,097,056 B2 * 8/2006 Ozawa ..... B65D 1/0246 215/44
7,124,905 B2 * 10/2006 Granger ..... B65D 41/045 222/571
7,735,663 B2 * 6/2010 Tanaka ..... B65D 1/0246 215/44
D631,351 S * 1/2011 Coon ..... D9/453
7,942,287 B2 * 5/2011 King ..... B65D 41/04 215/331
8,066,133 B2 * 11/2011 Takamatsu ..... B65D 41/0421 215/307
8,231,020 B2 * 7/2012 Taber ..... B65D 41/04 215/305
D675,526 S * 2/2013 Obrist ..... D9/453
8,365,934 B2 * 2/2013 Hamana ..... B65D 41/3428 215/253
8,453,866 B2 * 6/2013 Kamath ..... B65D 1/0246 215/331
8,459,486 B2 * 6/2013 Luburic ..... B65D 41/32 220/780
8,695,821 B2 * 4/2014 Bashyam ..... B65D 41/3428 215/305
D723,919 S * 3/2015 Taber ..... D9/453
9,211,979 B2 * 12/2015 Ekkert ..... B26F 1/20
D775,953 S * 1/2017 Ruthe-Steinsiek ..... D19/194
9,902,530 B2 * 2/2018 Smith ..... B65D 41/34
10,081,464 B2 * 9/2018 Krautkrämer ..... B65D 51/1688
D904,189 S * 12/2020 Twede ..... D9/453
11,198,543 B2 12/2021 Scherer et al.
11,643,255 B2 5/2023 Scherer et al.
11,801,977 B1 * 10/2023 Gray ..... B65D 47/0804
12,384,603 B2 8/2025 Klatt
2001/0027957 A1 * 10/2001 Kano ..... B65D 41/3428 215/354
2002/0158037 A1 * 10/2002 Kano ..... B65D 41/0421 215/354
2002/0166859 A1 * 11/2002 McGrew, Jr. ..... B65D 51/1622 220/366.1
2003/0192853 A1 * 10/2003 Zapata ..... B65D 41/3428 215/252
2005/0006334 A1 * 1/2005 Luker ..... B65D 41/0485 215/334
2005/0072751 A1 * 4/2005 Price ..... B65D 41/3428 215/252
2005/0247663 A1 * 11/2005 Gassner ..... B65D 41/0421 215/344
2005/0252878 A1 * 11/2005 Babcock ..... B65D 41/3428 215/252
2005/0269282 A1 * 12/2005 Luch ..... B65D 41/0471 215/354
2006/0086688 A1 * 4/2006 Tang-Lee ..... B65D 41/04 215/44
2006/0138073 A1 * 6/2006 Ooka ..... B65D 41/3428 215/354
2007/0251911 A1 * 11/2007 Russell ..... B65D 41/0414 215/344
2008/0087625 A1 * 4/2008 Kumata ..... B65D 41/0485 215/252
2009/0045158 A1 * 2/2009 Suriol ..... B65D 41/0435 215/256
2009/0152229 A1 * 6/2009 Falzoni ..... B65D 41/3409 215/331
2009/0301986 A1 * 12/2009 Phelan ..... B65D 41/0421 215/349
2010/0032402 A1 * 2/2010 Widmer ..... B65D 41/3428 215/329
2011/0186534 A1 * 8/2011 Nilsson ..... B65D 41/0421 215/40
2012/0031871 A1 * 2/2012 Molinaro ..... B65D 41/3447 215/44
2012/0091138 A1 * 4/2012 Sadiq ..... B65D 41/04 220/288
2013/0200036 A1 * 8/2013 Delage ..... B65D 41/0442 215/344

(56) References Cited

U.S. PATENT DOCUMENTS

| | | | | |
|---|---|---|---|---|
| 2013/0270211 | A1* | 10/2013 | Perrone | C03B 9/1932 215/44 |
| 2014/0001182 | A1* | 1/2014 | Wood | B65D 41/58 220/254.1 |
| 2014/0021157 | A1* | 1/2014 | Gren | B65D 41/0421 215/252 |
| 2014/0158660 | A1* | 6/2014 | Wood | B65D 41/0485 215/252 |
| 2014/0190925 | A1* | 7/2014 | Ropele | B65D 53/06 215/44 |
| 2014/0263335 | A1* | 9/2014 | Taber | B65D 41/0421 220/276 |
| 2015/0129534 | A1* | 5/2015 | Falzoni | B65D 41/0421 215/316 |
| 2015/0274378 | A1* | 10/2015 | Galownia | B65D 1/0246 215/337 |
| 2015/0344192 | A1* | 12/2015 | Ceccherini | B65D 55/024 215/250 |
| 2017/0166360 | A1* | 6/2017 | Falzoni | B65D 41/0435 |
| 2018/0134462 | A1* | 5/2018 | Dreyer | B65D 1/0246 |
| 2018/0257822 | A1* | 9/2018 | Neputy | B67B 3/20 |
| 2019/0112108 | A1 | 4/2019 | Reid | |
| 2019/0161247 | A1* | 5/2019 | Dreyer | B65D 41/0471 |
| 2021/0206545 | A1 | 7/2021 | Krautkramer | |
| 2021/0300648 | A1* | 9/2021 | Bassi | B65D 41/34 |
| 2021/0394968 | A1* | 12/2021 | Hohl | B65D 51/1661 |

FOREIGN PATENT DOCUMENTS

| | | | | | |
|---|---|---|---|---|---|
| DE | 202015009406 | U1 * | 9/2017 | | B65D 41/3447 |
| EP | 0076778 | | 4/1983 | | |
| EP | 0330964 | A1 | 9/1989 | | |
| EP | 1746038 | A1 | 1/2007 | | |
| EP | 1976766 | B1 | 3/2010 | | |
| JP | 2004035066 | A * | 2/2004 | | |
| JP | 2006056562 | A | 3/2006 | | |
| JP | 2009208778 | A | 9/2009 | | |
| JP | 2013086861 | A | 5/2013 | | |
| JP | 2013129430 | | 7/2013 | | |
| JP | 5481186 | B2 * | 4/2014 | | B65D 41/3409 |
| JP | 2018177302 | A | 11/2018 | | |
| KR | 19980028774 | | 7/1998 | | |
| WO | 84/03436 | A1 | 9/1984 | | |
| WO | 02/42171 | A1 | 5/2002 | | |
| WO | 2009/060291 | A1 | 5/2009 | | |
| WO | WO-2014060893 | A1 * | 4/2014 | | B65D 41/0421 |
| WO | 2017139902 | | 8/2017 | | |
| WO | 2018/204825 | A1 | 11/2018 | | |
| WO | 2020/007832 | A1 | 1/2020 | | |
| WO | 2021/074748 | A1 | 4/2021 | | |
| WO | 2022/027051 | A1 | 2/2022 | | |
| WO | 2022/053202 | A1 | 3/2022 | | |

* cited by examiner

Fig.2
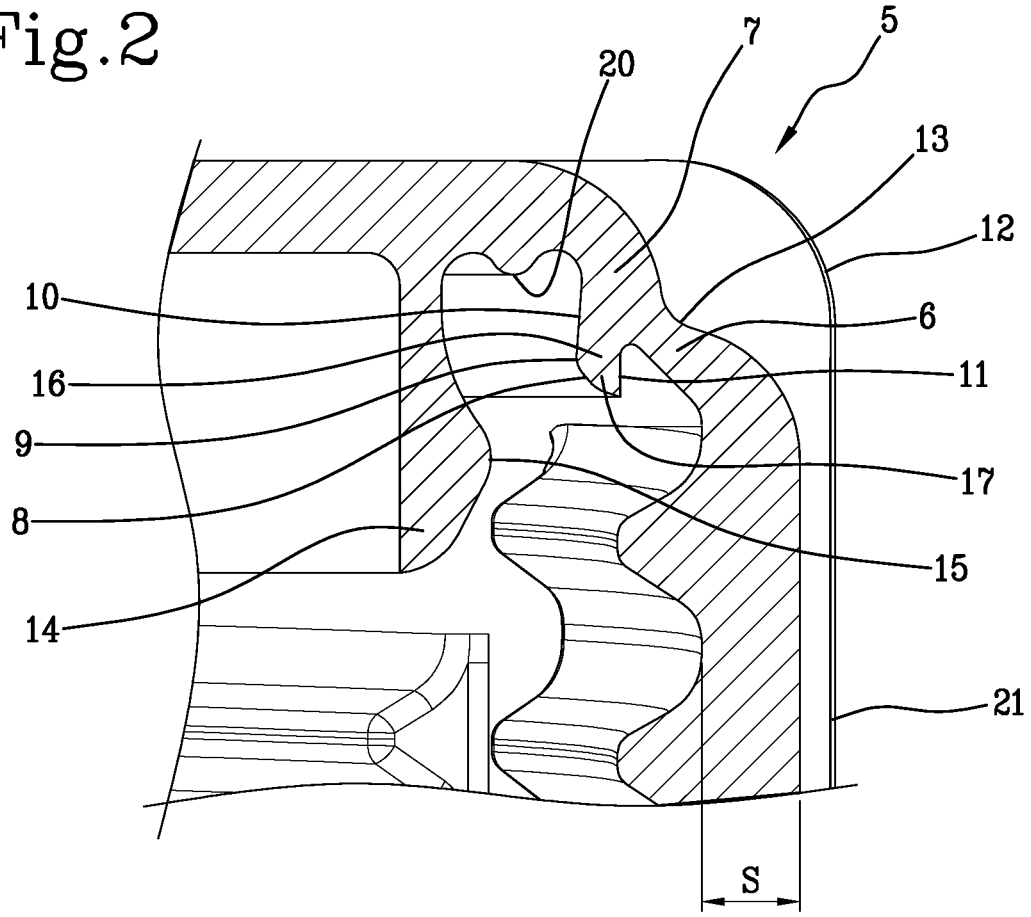
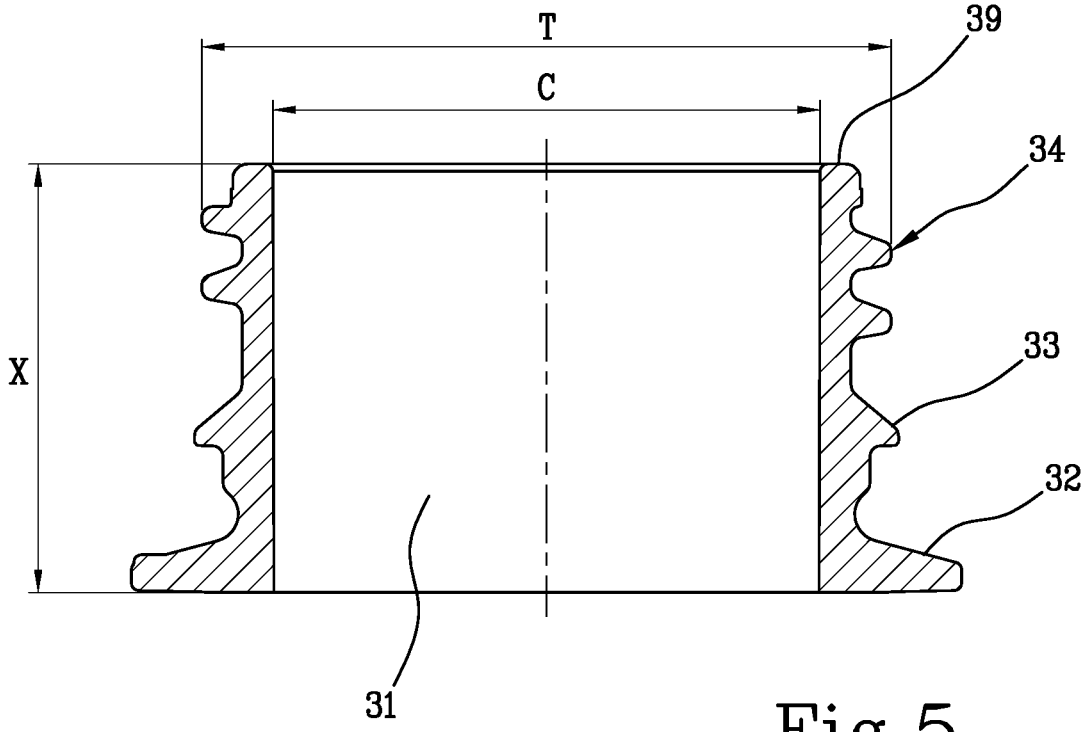
Fig.5

Fig.3
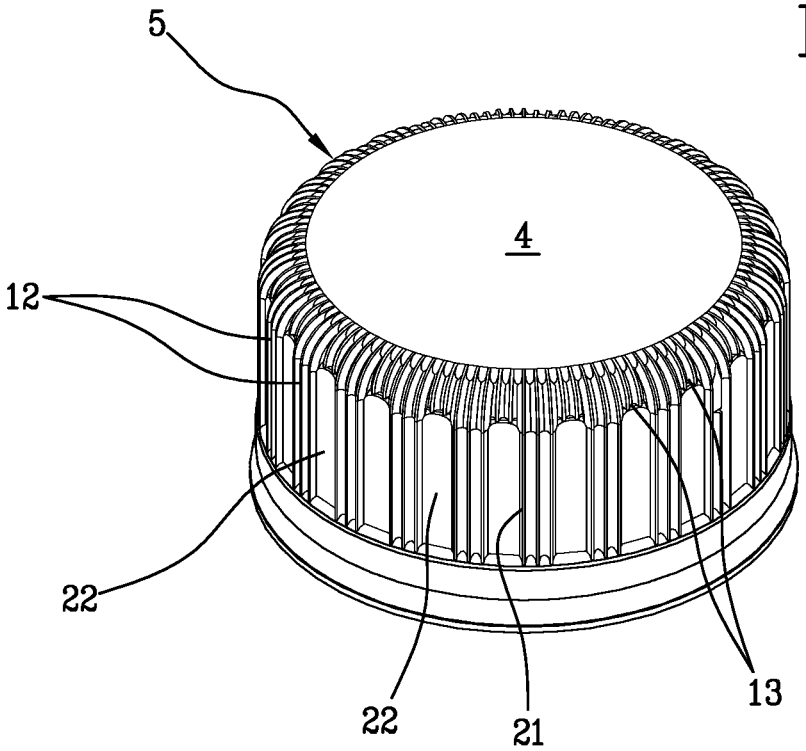
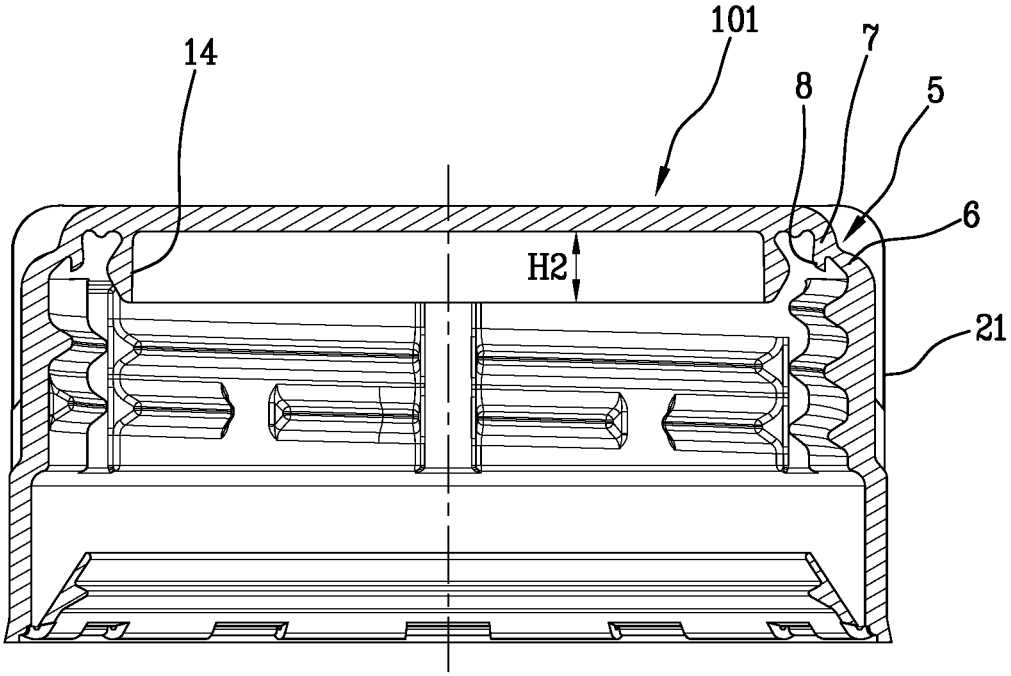
Fig.4

CAP FOR CONTAINERS

The invention relates to a cap for a container, which is particularly obtainable by moulding a polymeric material. The cap according to the invention is particularly suitable for closing containers such as bottles, in particular intended to contain carbonated beverages, for example beverages to which carbon dioxide has been added, although it may be used for closing bottles containing other types of liquid, for example liquids without carbon dioxide or liquids pressurised with nitrogen ($N_2$), or for closing other containers.

Caps for containers are known, which comprise a cylindrical lateral wall or skirt on an inner surface of which one or more anchoring elements are made, for example threads, suitable for allowing the cap to be removably fastened to a neck of the container. The prior art caps furthermore comprise a flat upper wall, having a substantially circular shape in plan view, from which the cylindrical lateral wall projects.

One or more sealing lips may project from the flat upper wall, the sealing lip(s) extending towards the inside of the cap and being intended to engage with a container neck, so as to obstruct passage of substances from the inside of the container to the outside or vice versa.

It is desirable that the caps for containers have a sufficient rigidity to keep the container well closed even in the presence of deformations which may occur during the life of the container closed by the cap. More specifically, relatively high pressures may be generated inside the container, for example because the container is exposed to relatively high temperatures, or because the container is accidentally deformed and crushed.

It is further desirable that the cap guarantees good sealing properties, that is to say, it prevents the escape of substances contained in the container and the entry into the container of extraneous substances coming from the outside environment.

Lastly, in recent years, the need has been increasingly felt to reduce the consumption of synthetic polymeric material with which the cap is made, for reasons linked to the protection of the environment and the reduction of pollution.

Some examples of prior art caps are disclosed in WO 2017/139902, JP 2013-129430, US 2015/129534, EP 0076778.

An object of the invention is to improve the caps for containers, in particular but not exclusively, the caps intended to close containers in which gaseous substances are present.

Another object is to provide a cap for a container which possesses a good structural rigidity.

A further object is to provide a cap for a container which is able to close the container in a substantially hermetic manner.

Another object is to provide a cap made of polymeric material, in which the consumption of polymeric material compared with the prior art caps is reduced.

According to the invention, there is provided a cap for a container, comprising an end wall, a skirt which extends about an axis, a corner zone interposed between the end wall and the skirt, the corner zone comprising a first wall portion which projects from the skirt towards the inside of the cap and a second wall portion which protrudes from the end wall and joins the first wall portion, wherein the cap further comprises an annular sealing lip which extends towards a free edge of the skirt from a region in which the first wall portion is joined to the second wall portion.

The annular sealing lip is suitable for engaging, in use, with the neck of the container, by coming into contact with an outer lateral surface of the neck, in such a way that a sealing action is exerted between the annular sealing lip of the cap and the outer lateral surface of the neck.

Thus, the annular sealing lip gives the cap good sealing properties, since it is able to engage with the outer lateral surface of the neck not only when the cap is undeformed, but also when the cap deforms, for example because a relatively high pressure has been generated inside the container.

The first wall portion and the second wall portion define a step on an outer surface of the corner zone.

The step makes it possible to eliminate material in a connecting zone between the end wall and the skirt, thus guaranteeing a saving in the use of polymeric material with respect to the case in which the end wall is joined to the skirt along a full corner.

In an embodiment, the edge zone may have a plurality of outer ribs.

The outer ribs may be distributed along the step defined by the first wall portion and by the second wall portion.

The outer ribs, if present, guarantee a good rigidity of the cap and prevent excessive deformations.

The invention can be better understood and implemented with reference to the accompanying drawings which illustrate non-limiting example versions thereof and in which:

FIG. 2 is an enlargement of a corner zone of the cap of FIG. 1;

FIG. 3 is a perspective view of a cap similar to that of FIG. 1;

FIG. 4 is a view like that of FIG. 1, showing a cap according to an alternative embodiment;

FIG. 5 is a cross section view of a neck of a container on which the cap of FIG. 1 or 4 can be applied;

FIG. 1 shows a cap 1 suitable for being removably fixed to a container for closing an open end thereof. The container which the cap 1 makes it possible to close may be a bottle intended to contain a liquid, for example a carbonated drink, or a bottle intended to contain a non-carbonated liquid, or a container of another type.

The cap 1 is made of polymeric material, for example by moulding. In particular, the cap 1 may be made by injection moulding or compression moulding, although other production technologies are not to be excluded. The cap 1 comprises a lateral wall or skirt 2, which extends about an axis Z. According to the example shown, the skirt 2 is substantially cylindrical. When the cap 1 is applied on a neck of the container, the skirt 2 is substantially vertical.

The skirt 2 is provided, on an inner surface thereof, with one or more anchoring elements 3 which allow the cap 1 to be removably fixed to a neck of the container to be closed. According to the example shown, the anchoring elements 3 comprise a plurality of portions of thread suitable for engaging with corresponding threads made on the neck of the container.

Figure 1:
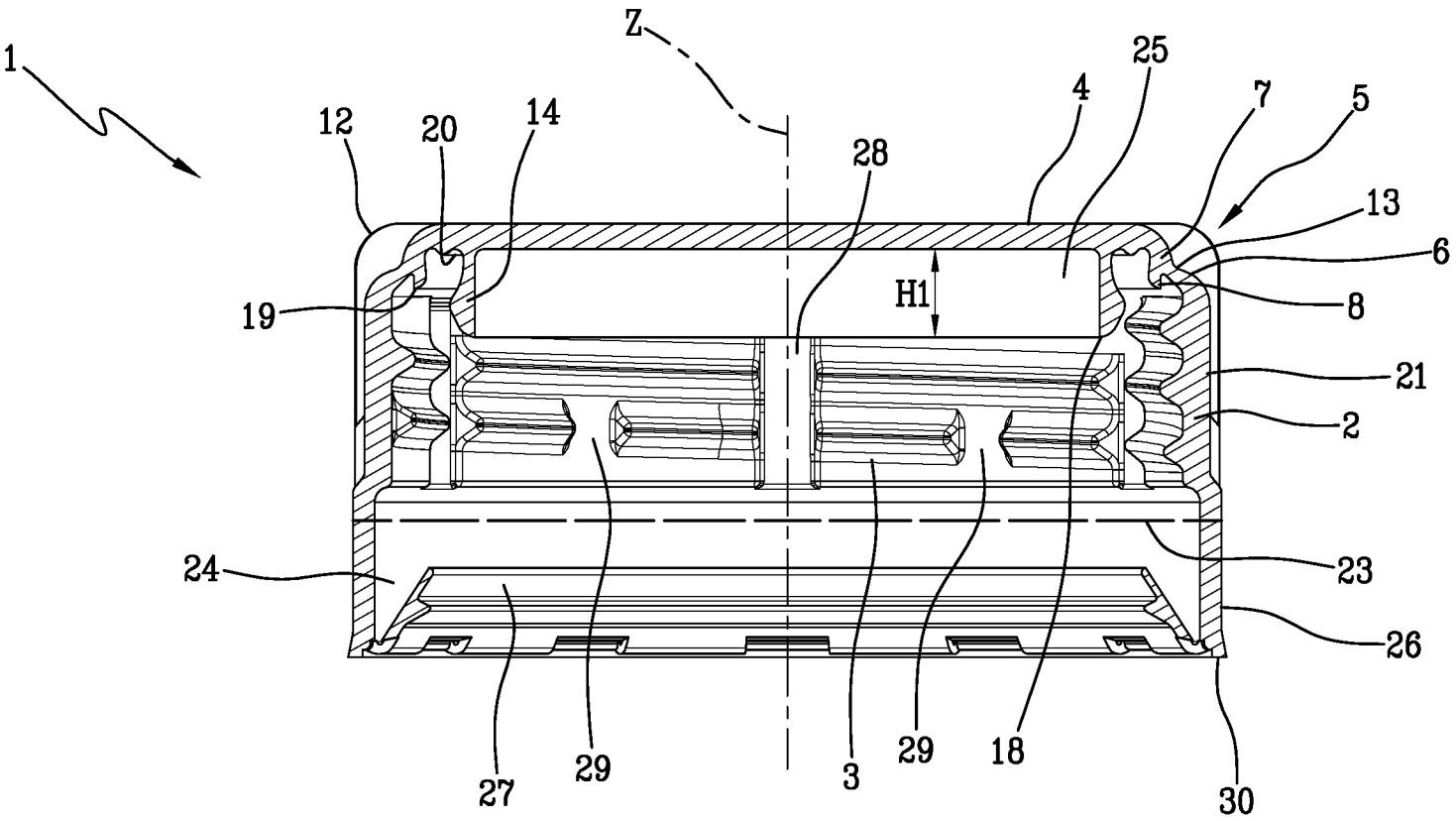
FIG. 1 is a cross section view of a cap for closing a container, taken on a vertical plane containing an axis of the cap.

According to an alternative embodiment not illustrated, the anchoring elements 3 may have a shape different from the portions of thread shown in FIG. 1. For example, the anchoring elements 3 might comprise beads or cam elements.

The cap 1 further comprises an end wall 4 positioned transversally, in particular perpendicularly, to the axis Z. The end wall 4 is substantially flat and has a substantially circular shape in plan view.

The end wall 4 closes the skirt 2 at one end of the skirt 2. At a further end of the skirt 2 opposite the end closed by the end wall 4, the skirt 2 has a free edge 30.

When the cap 1 is applied on a container neck, the end wall 4 is positioned at a height greater than the skirt 2, so as to close an open upper end of the container. The end wall 4 may therefore be defined as an upper wall of the cap 1, the adjective "upper" referring to the position of the end wall 4 during use.

An corner zone 5 is interposed between the skirt 2 and the end wall 4. The corner zone 5 is shown in detail in the enlarged portion of FIG. 2.

The corner zone 5 comprises a first wall portion 6 which projects towards the inside of the cap 1 from the skirt 2. The first wall portion 6 extends about the axis Z. The first wall portion of 6 is positioned transversally relative to the axis Z. The first wall portion 6 projects towards the inside of the cap 1, that is to say, towards the axis Z, from an upper edge zone of the skirt 2.

The first wall portion 6 is tilted relative to the skirt 2.

The first wall portion 6 has an overall shape like a truncated cone or a substantially flat circular crown, concentric with the axis Z.

The corner zone 5 further comprises a second wall portion 7 which is interposed between the first wall portion 6 and the end wall 4. More specifically, the second wall portion 7 connects the first wall portion 6 to a peripheral edge of the end wall 4.

Also the second wall portion 7 extends about the axis Z.

The second wall portion 7 has an inclination different from the first wall portion 6. In particular, the second wall portion 7 may be less tilted, that is to say, arranged in a configuration closer to a vertical configuration, than the first wall portion 6. The adjective "vertical" is used here with reference to the position which the cap adopts when it is applied on a container, in which the axis Z is substantially vertical and the end wall 4 is positioned at a height greater than the skirt 2.

According to the example shown, the second wall portion 7 is substantially vertical.

The first wall portion 6 may have a thickness which decreases from the skirt 2 towards the second wall portion 7, or a substantially constant thickness.

The first wall portion 6 and the second wall portion 7, which have different inclinations to each other, define a step in the corner zone 5, in particular on an outer surface of the corner zone 5.

The term "step" does not imply that the first wall portion 6 and the second wall portion 7 are substantially perpendicular to each other, as shown for example in FIG. 2.

In a cross section taken on a plane containing the axis Z, the first wall portion 6 extends transversely to the second wall portion 7.

The cap 1 comprises an annular sealing lip 8 which projects towards the free edge 30 from a region in which the first wall portion 6 is joined to the second wall portion 7. The annular sealing lip 8 protrudes towards the at least one anchoring element 3 inside the cap 1 to engage with a neck of the container on which the cap 1 is applied, as described in more detail below.

The annular sealing lip 8 extends about the axis Z. More specifically, in the example shown the annular sealing lip 8 extends mainly parallel to the axis Z. If the cap 1 is positioned as shown in FIG. 1, in such a way that the axis Z is positioned vertically, the annular sealing lip 8 extends mainly vertically.

The annular sealing lip 8 extends like a continuation of the second wall portion 7 towards the inside of the cap 1. The annular sealing lip 8 is delimited by an inner surface 9 which defines a continuation, without discontinuity, of an inner surface 10 delimiting the second wall portion 7 inside the cap 1.

The annular sealing lip 8 protrudes towards the free edge 30 relative to the first wall portion 6.

The annular sealing lip 8 has a thickness which decreases towards the free edge 30.

Optionally, the inner surface 9 which delimits the annular sealing lip 8 is a curved surface, for example having an internal diameter which increases in a direction directed from the end wall 4 towards the free edge 30.

The annular sealing lip 8 is further delimited by an outer surface 11 which may, for example, have the shape of a cylinder coaxial with the axis Z, or a truncated cone shape.

In the example of FIG. 1, the annular sealing lip 8 has a root portion 16, positioned closer to the second wall portion 7, having a substantially constant thickness, and an end portion 17, positioned further away from the second wall portion 7, having a thickness which decreases towards the free edge 30.

The inner surface 9 of the annular sealing lip 8 is suitable for engaging with an outer lateral surface of the neck of the container, in order to apply a sealing action in contact with the neck of the container.

The cap 1 may comprise a plurality of outer ribs 12 arranged in the corner zone 5 outside the first wall portion 6 and the second wall portion 7. Each outer rib 12 joins the first wall portion 6 to the second wall portion 7.

The outer ribs 12 have a substantially flat shape. Each outer rib 12 extends mainly in a plane containing the axis Z. The outer ribs 12 are therefore radial ribs.

The outer ribs 12 have a rounded outer profile.

The outer ribs 12 have a thickness which is substantially constant between one rib and the other, as well as along the single rib.

The outer ribs 12 may be angularly equidistant.

The outer ribs 12 protrude outwards from the step defined between the first wall portion 6 and the second wall portion 7.

A recess 13 is interposed between two consecutive outer ribs 12.

Each recess 13 is delimited by the first wall portion 6 and by the second wall portion 7, as well as by the two outer ribs 12 between which it is interposed.

Consequently, it is possible to identify, in the corner zone 5 of the cap 1, a plurality of recesses 13 which can be distributed in an angularly equidistant manner about the axis Z.

The recesses 13 may have an angular extension about the axis Z equal between one recess 13 and the other.

The outer ribs 12 are optional. According to an embodiment not illustrated, the outer ribs 12 might be absent.

The cap 1 may further be provided with an inner sealing element 14, having an annular shape, which projects from the end wall 4 towards the inside of the cap 1, more specifically towards the free edge 30. The inner sealing element 14 is suitable for being inserted inside the neck of the container to sealingly engage with the inner lateral surface of the neck. In particular, the inner sealing element 14 may be delimited by a convex sealing surface 15 for coming into contact with the lateral inner surface of the neck of the container.

The inner sealing element 14 is positioned inside the annular sealing lip 8, that is to say, it has an average diameter less than the average diameter of the annular sealing lip 8.

The inner sealing element 14 has a height H1 greater than the height of the annular sealing element 8. This means that the inner sealing element 14 has a free end 18 closer to the free edge 30 with respect to an end 19 of the annular sealing lip 8.

The cap 1 may comprise a front sealing element 20, shaped like an annular protrusion which projects from the end wall 4 towards the inside of the cap 1. The front sealing element 20 is interposed between the annular sealing lip 8 and the inner sealing element 14. In other words, the front sealing element 20 has an average diameter less than the annular sealing lip 8, but greater than the average diameter of the inner sealing element 14.

The front sealing element 20 is shorter than the annular sealing lip 8 and the inner sealing element 14, so as to engage with an upper edge 39 of the neck of the container, shown in FIG. 5.

In an embodiment, the front sealing element 20 may be omitted.

Knurling lines 21 may be present on an outer surface of the skirt 2 to make it simpler both to apply the cap 1 to a container in an automatic capping line and to grip the cap 1 by the user, when the cap 1 must be removed from the container or applied to the container.

The knurling lines 21 may have the shape of rows in relief which project from the outer surface of the skirt 2, parallel to the axis Z.

As shown in FIG. 3, the knurling lines 21 may further be grouped together in groups, two adjacent groups of knurling lines 21 being separated by a smooth portion 22 (that is to say, not knurled) of outer surface of the skirt 2. In the example of FIG. 3, the groups of knurling lines 21 are formed by three knurling lines 21.

Alternatively, the knurling lines 21 may be distributed according to other arrangements, for example they can be distributed equidistantly about the axis Z.

The knurling lines 21 may extend as a continuation, along the skirt 2, of all or a part of the outer ribs 12. In the latter case, as shown in FIG. 2, the outer ribs 12 from which the knurling lines 21 extend can project towards the outside of the cap 1 more than the other outer ribs 12.

Furthermore, at least one separation line 23, shown in FIG. 1, may be provided on the skirt 2, that is to say, a breakable line along which the material which forms the cap 1 can break the first time the container closed by the cap 1 is opened. The separation line 23 defines on the cap 1 a tamper evident ring 24 and a closing element 25. The tamper evident ring 24 is interposed between the separation line 23 and the free edge 30 and is suitable for remaining anchored to the neck of the container after the container has been opened. The closing element comprises the end wall 4 and a portion of the skirt 2 interposed between the end wall 4 and the separation line 23. The closing element 25 may be removed from the container to access its contents or alternatively reapplied on the container. The separation line 23 may be defined by a plurality of cuts between which respective bridge elements are interposed. The bridge elements are suitable for being broken the first time the closing element 25 is removed from the container, thereby signalling that the container has already been opened.

Alternatively, the separation line 23 may be defined by one or more portions of thin thickness in which the material forming the cap 1 has a thickness less than in the rest of the skirt 2.

The separation line 2 may be obtained in different ways, for example by a cutting operation performed after the cap 1 has been moulded, or directly during moulding.

The tamper evident ring 24 may comprise an annular band 26, delimited by the separation line 23 and extending up to the free edge 30. The tamper evident ring 24 may further comprise a retaining element 27, suitable for engaging with the neck of the container to prevent the tamper evident ring 24 from being removed from the container when the container is opened for the first time. According to the example shown, the retaining element 27 comprises a flap connected to the annular band 26 at the free edge 30 and folded upwards inside the cap 1, so as to be surrounded by the annular band 26. The retaining element 27 is suitable for interacting with an annular protrusion located outside the neck of the container.

The retaining element 27 may also be shaped differently from what is indicated in FIG. 1. For example, the retaining element 27 may comprise a plurality of tabs folded towards the inside of the cap 1, or a plurality of beads which project from an inner surface of the annular band 26 towards the inside of the cap 1.

The cap 1 may have one or more vent passages 28, one of which is shown in FIG. 1. The vent passage 28 is intended to allow a controlled and gradual escape of any pressurised gas present inside the container, whilst the closing element 25 is removed from the container, for example by unscrewing. The vent passage 28 may be shaped like an axial groove, extending parallel to the axis Z, at which the anchoring elements 13 are interrupted.

FIG. 1 shows a vent passage 28 which interrupts all the anchoring elements 13 provided in the angular position (about the axis Z) in which the vent passage 28 is located.

As an alternative to the vent passage 28 of the type described above, or in addition to the vent passage 28, it is possible to provide one or more partial interruptions 29 which, as shown in FIG. 1, interrupt only partly the anchoring elements 13. In the example of FIG. 1, the partial interruptions 29 interrupt only a portion of thread closest to the tamper evident ring 25, leaving unaltered a further portion of thread closer to the end wall 4.

The partial interruptions 29 have a vent function, that is to say, they allow the escape of gas possibly present in the container, even though in a more limited manner than the vent passages 28.

The partial interruptions 29 may be positioned in respective angular positions, about the axis Z, different from the angular positions in which the vent passages 28 are positioned.

Figure 6:
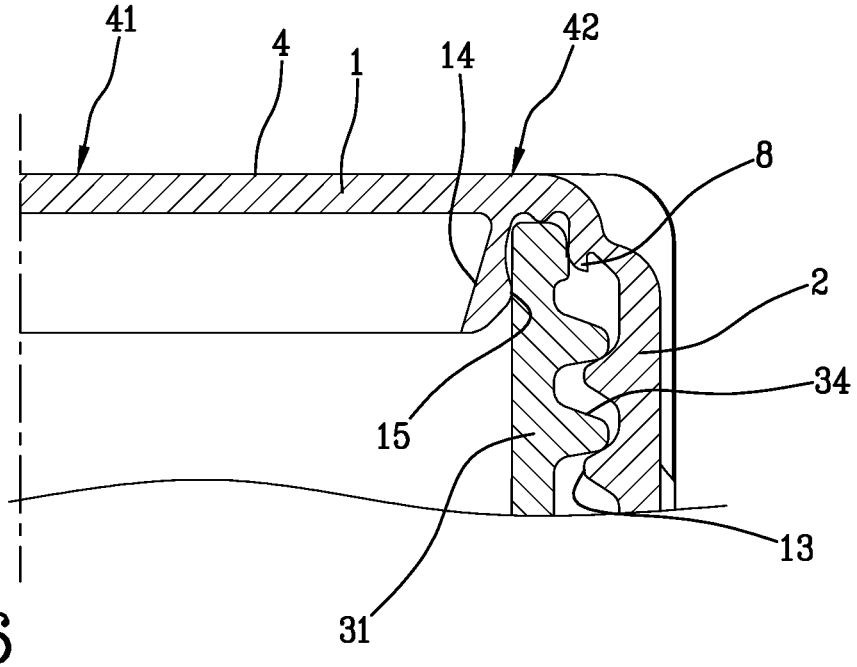
FIG. 6 is a cross section view like that of FIG. 1, showing a portion of a cap when the latter is applied on a neck of container under normal operating conditions.

The cap 1 is intended to be applied on a neck 31 of a container, as shown in FIG. 6.

The neck 31, which is also visible in FIG. 5, may comprise a fastening arrangement 34 suitable for allowing the closing element 25 of the cap 1 to be fastened to the neck 31 or removed from the latter. The fastening arrangement 34 may comprise one or more outer threads made on the neck 31 and suitable for engaging with the anchoring elements 13 of the cap 1.

As shown in FIG. 5, the neck 31 may further comprise an annular element 32, which projects from the neck 31 towards the outside and which can perform various functions. For example, the annular element 32 may be used for transporting the container during its production and during filling. Moreover, the annular element 32 acts as a stop element for the tamper evident ring 24, since it prevents the tamper evident ring 24 from falling along the neck 31 below the annular element 32, after the closing element 25 has been detached from the tamper evident ring 24.

Between the annular element 32 and the fixing arrangement 34 an annular enlargement 33 is interposed, the annular enlargement 33 projecting outwards from the neck 31 and being suitable for engaging with the retaining element 27 of the tamper evident ring 24, as described in more detail below.

In use, the container is filled with the liquid or another desired substance, after which the cap 1 is applied on the neck 31.

The anchoring elements 13 engage with the fastening arrangement 34 to keep the cap 1 in a closed position.

The retaining element 27 made on the tamper evident ring 24 is positioned below the annular enlargement 33.

The annular sealing lip 8 is positioned outside the neck 31, that is to say, it surrounds an end portion of the neck 31.

The inner surface 9 of the annular sealing lip 8 is in contact with an outer lateral surface of the neck 31. In particular, the annular sealing lip 8, which is flexible, may bend slightly outwards when it engages with the neck 31.

The inner sealing element 14 is positioned inside the neck 31, in such a way that the convex sealing surface 15 is in contact with an inner lateral surface of the neck 31. More specifically, the inner sealing element 14 may bend towards the inside when it is inserted inside the neck 31.

An end portion of the neck 31 is thus inserted between the annular sealing lip 8 and the inner sealing element 14.

An upper edge of the neck 31 abuts against the front sealing element 20 which, if present, ensures that the neck 31 has penetrated in the cap 1 by the correct amount.

The annular sealing lip 8, the inner sealing element 14 and the front sealing element 20 prevent the substances, particularly gaseous ones, present inside the container from escaping into the outside environment and, at the same time, prevent the substances present in the outside environment from entering the container. The integrity and properties of the liquid or other substance present in the container are thus preserved.

Figure 7:
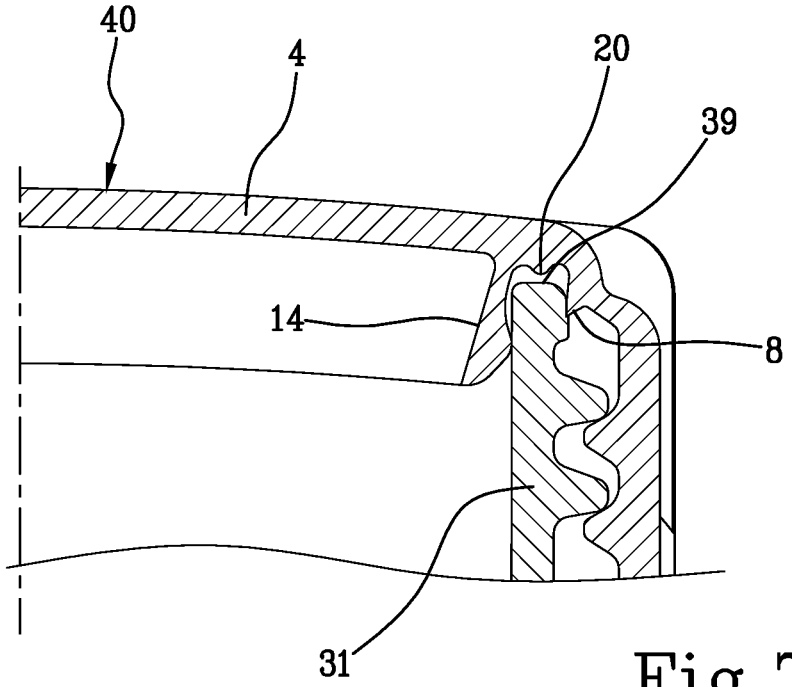
FIG. 7 is a cross section view like that of FIG. 1, referred to a condition in which a pressure greater than atmospheric pressure has originated inside the container.

The cap 1 is able to close the container in a substantially hermetic manner even when pressures develop inside the container such as to cause a swelling of the cap 1, in particular of the end wall 4 which, as shown in FIG. 7, may in this case adopt a dome-shaped configuration 40. These pressures, which are originated easily in particular when the cap 1 is used to close a container containing a carbonated drink, may, for example, be generated because the container closed by the cap 1 is exposed to relatively high temperatures, or because it has been accidentally crushed. If the end wall 4 deforms, adopting the dome-shaped configuration 40 of the type shown in FIG. 7, the annular sealing lip 8, which is flexible, bends and deforms in such a way as to guarantee in any case contact with the neck 31 of the container, so that the sealing action exerted by the annular sealing lip 8 still remains present.

More specifically, the annular sealing lip 8 and the inner sealing element 14 remain in contact with the neck 31 even when the pressure inside the container increases until causing detachment of the front sealing element 20 from the neck 31, more specifically from the upper edge 39 of the neck 31, as shown in FIG. 7.

The inner sealing element 14 also deforms, for example adopting a tilted configuration in a different manner from that shown in FIG. 6. The contact between the convex sealing surface 15 and the neck 31 is in any case maintained.

Owing to the recesses 13, the first wall portion 6 and the second wall portion 7 allow a corner zone 5 to be obtained which is lightened relative to the case in which the corner zone 5 is solid, that is to say, where no recesses 13 are provided between consecutive outer ribs 12. This makes it possible to limit the quantity of polymeric material to be used for producing the cap 1.

The outer ribs 12 allow the corner zone 5 to be stiffened, ensuring that the rigidity is sufficient practically for the main industrial requirements.

Moreover, the first wall portion 6 guarantees a good resistance in cases in which the skirt 2 tends to widen, for example because it is pushed towards the outside due to the effect of the thermal expansion of the neck 31, linked to the high temperatures to which the neck 31 can be subjected. Given the tilted configuration of the first wall portion 6, in order to deform the first wall portion 6 it is necessary that a component of the force applied to the first wall portion 6 compresses the first wall portion 6 in its direction of main extension, that is to say, transversely to the axis Z, which requires relatively high forces.

FIG. 4 shows a cap 101 according to an alternative embodiment, which differs from the cap 1 shown in FIGS. 1 and 2 mainly because it comprises an inner sealing element 14 having a height H2 less than the corresponding height of the inner sealing element 14 included in the cap 1, with other dimensions being the same.

Both in the cap 1 shown in FIGS. 1 to 3 and in the cap 101 shown in FIG. 4, the thickness of the end wall 4 may be varied according to the specific requirements of the combination of the cap with the container which the cap is intended to close.

When the container closed by the cap 1, 101 is stored, for example inside a storage unit or a container, high temperatures may be reached, even greater than 50° C., due in particular to exposure to the sun or the high external temperatures.

At these temperatures, the material which forms the neck 31 can soften, especially if the container is made of amorphous materials such as polyethylene terephthalate. The cap, which is usually made of semi-crystalline materials, which maintain a greater rigidity even at relatively high temperatures, is, on the other hand, stiffer and, under the action of high pressures generated inside the container, can deform and thus deform the neck 31, damaging it.

In order to prevent this from happening, it is possible to select, during the design of the cap, the thickness of the end wall 4 in such a way that the end wall 4 allows the gases present in the container to escape at least partly, so that the pressure present in the container decreases and permanent damage to the container by the cap 1, 101 is avoided.

In particular, it is possible to suitably select the thickness of the end wall 4 in some predetermined zones, such as, for example, in a central zone 41 of the end wall 4, close to the axis Z, and in a peripheral zone 42 of the end wall 4, close to the annular sealing lip 8.

The thickness of the end wall 4 may be constant, which means that, in the central zone 41, the thickness of the end wall 4 is equal to the thickness of the end wall 4 in the peripheral zone 42.

Alternatively, different zones of the end wall 4 may have different thicknesses. For example, the thickness of the end wall 4 in the central zone 41 may be different (greater or smaller) from the thickness of the end wall 4 in the peripheral zone 42.

If the container closed by the cap 1, 101 contains a carbonated drink, the thickness of the end wall 4 may vary from 0.6 to 1.5 mm, more specifically from 0.8 to 1.2 mm.

If the thickness of the end wall 4 in the central zone 41 is different from the thickness of the end wall 4 in the peripheral zone 42, the difference between these two thicknesses may vary from 0.1 to 0.6 mm, more specifically from 0.2 to 0.4 mm.

If the container closed by the cap 1, 101 is intended to contain a carbonated drink, the skirt 2 may have a thickness S of between 0.6 and 1.1 mm, more specifically between 0.7 and 0.9 mm.

As shown in FIG. 2, the thickness S is measured between an outer surface of the skirt 2 (in particular an outer surface from which the knurling lines 21 protrude, if present) and an inner surface of the skirt 2 from which the at least one anchoring element 13 protrudes.

The vent passages 28 and/or the interruptions 29 may be shaped as recesses having a depth of between 0 and 0.5 mm. If the depth of the vent passages 28 and/or of the interruptions 29 is equal to 0, the vent passages 28 and/or the interruptions 29 are zones in which the anchoring elements 13 are not present.

More specifically, the depth of the vent passages 28 and/or of the interruptions 29 may be between 0.15 and 0.35 mm.

If the anchoring element 13 comprises an inner thread made on the cap, suitable for engaging with an outer thread made on the neck 31, the inner thread and the outer thread may have angular extensions different to each other.

In particular, the inner thread present on the cap may have an angular extension greater than the angular extension of the outer thread present on the neck.

More specifically, in the case of caps 1, 101 intended to be applied to containers having a volume greater than one litre, when the cap 1, 101 is screwed on the neck 31, the inner thread present on the cap can continue towards the free edge 30 beyond the outer thread present on the neck 31. The inner thread present on the cap 1, 101, which is screwed on the neck 31, can continue beyond the outer thread present on the neck 31, towards the free edge 30, for an angular extension of between 30° and 270°, in particular between 90° and 180°.

In addition or alternatively to the above, it may occur that, when the cap 1, 101 is screwed to the neck 31, the inner thread formed on the cap extends beyond the outer thread formed on the neck, towards the end wall 4, for an angular extension of between 10° and 90°, for example between 20° and 60°.

The cap 1, 101, or caps having a similar structure, may be applied to all the necks for carbonated drinks currently used.

In particular, the cap according to the invention may be applied to the low necks recently introduced, that is to say, to necks having a height X of between 12 and 17 mm and an internal diameter C (see FIG. 5), in an opening zone, equal to approximately 21.75 mm.

As shown in FIG. 5, the height X is the distance between a lower surface of the annular element 32 and the upper edge 39 of the neck 31.

The cap according to the invention may be applied both to necks having a single thread (that is to say, a thread extending along a single spiral), and to necks having more than one thread, for example to necks having two threads.

It is further possible to apply the cap according to the invention to necks having a nominal diameter equal to 38 mm, for example necks with a height X of approximately 24.5 mm, outer diameter T of the thread of approximately 37.2 mm (see FIG. 5) and inner diameter C of the neck, in the opening zone, of approximately 31 mm.

The cap according to the invention may further be used in combination with lower necks such as the so-called "38 mm" necks, for example necks with a height X of approximately 17.5 mm and an internal diameter C, in the opening zone, equal to approximately 32 mm.

Further, the cap according to the invention may be applied on special necks, for example of the type having a height X of approximately 12.6 mm, an inner diameter C, in the opening zone, equal to 25.1 mm and an outer diameter T of the thread of approximately 29.5 mm.

For a neck having a height X of approximately 15 mm and an outer diameter T of the thread of approximately 26.5 mm, intended to be applied on a container for carbonated drinks, it is possible to use a cap of the type described above having a minimum height of approximately 14 mm and an outer diameter approximately between 28 and 30 mm.

In general, the cap 1, 101, or a similar cap, may have a weight of between 1.5 and 2.2 grams, if intended to be applied to a container containing a carbonated drink.

The cap 1, 101, or a similar cap, may have a weight of between 1 and 1.8 grams, if intended to be applied to a container containing a non-carbonated drink.

The caps described above are made of polymeric material, for example polypropylene (PP) or polyethylene (PE).

If PE is used, its density may range from low density to high density. In particular, it is possible to use high-density polyethylene (HDPE).

The high-density polyethylene (HDPE) used to produce the caps described above can have the following properties:

- density between 950 and 968 kg/m3;
- a melt index of 0.3 to 20 g under the following measurement conditions: 10 minutes, 190° C., 2.16 kg;
- large, or narrow, or unimodal, or multi-modal distribution of molecular weight.

If PP is used, the material may be in the form of a homopolymer, or heterophasic copolymer, or statistical copolymer.

The melt index of the PP may vary from 2 to 20 g, under the following measurement conditions: 10 minutes, 230° C., 2.16 kg.

The caps of the type described above are suitable for use, for example, on the necks shown in the following list, each neck being associated with a respective nomenclature which identifies the name of the neck, the diameter of the outer surface of the neck, and the diameter of the dispensing opening of the neck, as per CETIE (www.cetie.org) or ISBT (www.bevech.org) nomenclature.

For each acronym, if the neck is also a European standard, the reference number is also indicated.

| | |
|---|---|
| GME30.39 25/22 mm | |
| GME30.28 26/22 mm | DIN EN 16594: 2016 |
| GME30.38 26/22 mm | |
| GME30.37 26/22 mm | |
| GME30.40 26/22 mm | |
| GME30.24 27/22 mm | EN 16067: 2012 |
| PCO1881 28/22 mm | |
| PCO1810 28/22 mm | |
| GME30.26 29/25 mm | EN 16592: 2015 |
| GME30.21 30/25 mm | EN 16064: 2012 |
| GME30.31 32/26 mm | |
| GME30.36 32/27 mm | |
| GME30.30 33/28 mm | |
| GME30.25 38/33 mm | |
| GME30.29 38/32 mm | |

The invention claimed is:

1. A combination of a cap and a container, the cap comprising an end wall, a skirt which extends about an axis, a corner zone interposed between the end wall and the skirt, the corner zone comprising a first wall portion which projects from the skirt towards the inside of the cap and a second wall portion which protrudes from the end wall and is joined to the first wall portion, the first wall portion and the second wall portion defining a step on a surface of the corner zone facing towards the outside of the cap, the container comprises a neck, the neck having an end portion, an outer lateral surface and an outer thread having an angular extension, wherein the cap further comprises an annular sealing lip delimited by an inner surface configured to engage with the outer lateral surface of the neck of the container, wherein the annular sealing lip extends towards a free edge of the skirt from a region in which the first wall portion is joined to the second wall portion;

wherein the cap further comprises a plurality of outer ribs located in the corner zone, wherein the outer ribs are the continuation of a plurality of knurling lines provided on the skirt, wherein the annular sealing lip is the continuation of the second wall portion extending below a bottom edge of the second wall portion along axis (Z) towards the free edge and the annular sealing lip is positioned outside the end portion of the neck and the inner surface of the annular sealing lip is in contact with the outer lateral surface of the neck, and wherein the cap further comprises an inner thread having an angular extension, the inner thread of the cap engaged with the outer thread of the neck and the angular extension of the inner thread of the cap is of different length from the angular extension of the outer thread of the neck.

2. The combination according to claim 1, wherein the annular sealing lip extends mainly parallel to the axis.

3. The combination according to claim 1, wherein the annular sealing lip has a thickness which decreases in a direction directed towards the free edge.

4. The combination according to claim 1, wherein the inner surface which delimits the annular sealing lip is curved.

5. The combination according to claim 1, wherein the end wall has a thickness of between 0.6 and 1.5 mm.

6. The combination according to claim 1, wherein the end wall has, in a central zone thereof close to the axis, a thickness different from the thickness of the end wall in a peripheral zone thereof close to the annular sealing lip, and wherein the difference between the thickness of the end wall in the central zone and in the peripheral zone is between 0.1 and 0.6 mm.

7. The combination according to claim 1, wherein on an inner surface of the skirt at least one anchoring element is provided for removably fixing the cap to a neck of the container.

8. The combination according to claim 7, wherein on the inner surface of the skirt at least one vent is provided to let escape from the container any gas during opening, the at least one vent being shaped like a recess that interrupts the at least one anchoring element and penetrates into the thickness of the skirt for a depth of less than 0.5 mm.

9. The combination according to claim 1 and further comprising an inner sealing element which projects from the end wall towards the inside of the cap, the inner sealing element having an annular shape and being arranged in a position inside the annular sealing lip coaxially with the annular sealing lip.

10. The combination according to claim 9, wherein the inner sealing element is delimited by a convex sealing surface facing towards the annular sealing lip, the inner sealing element being intended to be positioned inside a neck of the container so that the convex sealing surface engages with a lateral inner surface of the neck.

11. The combination according to claim 9, and further comprising a front sealing element shaped like an annular protrusion which projects from the end wall in a position interposed between the annular sealing lip and the inner sealing element for engaging with a front edge of the neck.

12. The combination according to claim 1, intended to be applied to a container containing a carbonated drink, the cap having a weight of between 1.5 and 2.2 grams.

13. The combination according to claim 1, intended to be applied to a container containing a non-carbonated drink, the cap having a weight of between 1 and 1.8 grams.

14. The combination according to claim 1, wherein the inner thread of the cap has an angular extension about said axis that continues towards the free edge and beyond the outer thread on the neck.

15. The combination according to claim 1, wherein, when the cap is screwed to the neck, the angular extension of the inner thread of the cap continues towards the free edge and beyond the outer thread present on the neck, such that the difference of angular extension between the inner thread of the cap and the outer thread of the neck is 30° and 270°.

16. The combination according to claim 1, wherein, when the cap is screwed to the neck, the end of the angular extension of the inner thread of the cap extends beyond the end of the outer thread of the neck, towards the end wall, such that the difference of angular extension between the inner thread of the cap and the outer thread of the neck is 10° and 90°.

17. The combination according to claim 1, wherein the outermost diameter of the second wall portion is greater than the outer diameter of the annular sealing lip.

18. The combination according to claim 17, wherein the diameter of the inner surface of the annular sealing lip is equal to or smaller than the inner diameter of the second wall portion.

19. The combination according to claim 1, wherein the inner surface of the annular sealing lip curves towards the skirt at the bottom portion of the annular sealing lip to engage with an outer lateral surface of a neck of the container.

20. The combination according to claim 1, wherein the annular sealing lip is configured to bend towards the axis of the cap when the end wall deforms outward.

* * * * *